United States Patent [19]

Bradley

[11] 4,213,428

[45] Jul. 22, 1980

[54] ELECTROMAGNETIC AUGMENTATION OF INTERNAL COMBUSTION ENGINES

[76] Inventor: Phecell Bradley, 214 E. Genesee, Flint, Mich. 48505

[21] Appl. No.: 770,751

[22] Filed: Feb. 22, 1977

[51] Int. Cl.[2] ..... F02B 71/00

[52] U.S. Cl. ..... 123/46 E; 123/1 R; 123/1 A; 123/DIG. 7

[58] Field of Search ..... 123/46 E, 1 R, DIG. 7, 123/2; 290/1 R, 1 A, 1 B, 1 C

[56] References Cited

U.S. PATENT DOCUMENTS

| | | | |
|---|---|---|---|
| 688,494 | 12/1901 | Stern | 290/1 R |
| 1,167,366 | 1/1916 | Fessenden | 123/46 E |
| 1,515,933 | 11/1924 | Crowder | 123/46 E |
| 1,785,643 | 12/1930 | Noack et al. | 123/46 E |
| 2,060,263 | 11/1936 | Sweeney | 123/1 R |
| 2,334,688 | 11/1943 | Norton | 123/46 E |
| 2,362,151 | 11/1944 | Ostenberg | 290/1 R |
| 3,636,390 | 1/1972 | Stauder et al. | 290/1 |
| 3,766,399 | 10/1973 | Demetrescu | 123/46 E |

*Primary Examiner*—Charles J. Myhre

*Assistant Examiner*—R. A. Nelb

*Attorney, Agent, or Firm*—Irving M. Weiner; Pamela S. Burt; Melvin Yedlin

[57] ABSTRACT

Combustion induced motion of a piston in an internal combustion engine is augmented by the application of an intermittent or variable magnetic field reacting between the engine block and moving piston in a manner such that the piston is magnetically impelled along its path of movement. A permanent magnet is mounted on the piston with its axis of magnetic polarity aligned with the path of travel of the piston. An electromagnet mounted in the engine block is cyclically supplied with electric current to generate a magnetic field reacting with the magnet on the piston to cyclically magnetically attract or repel the piston in synchronism with the motion of the piston induced by fuel ignition. In the case of a reciprocatory piston, switching means are employed to reverse the polarity of the magnetic field in synchronism with the reversal of piston movement. Application of the magnetic field by the electromagnetic may be varied to occur over a selectively varied portion only of each piston stroke.

5 Claims, 4 Drawing Figures

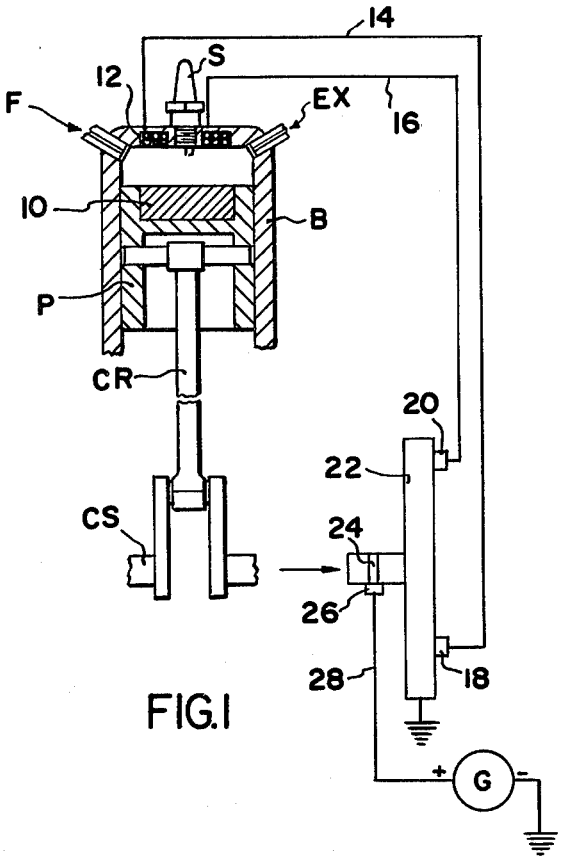
FIG.1
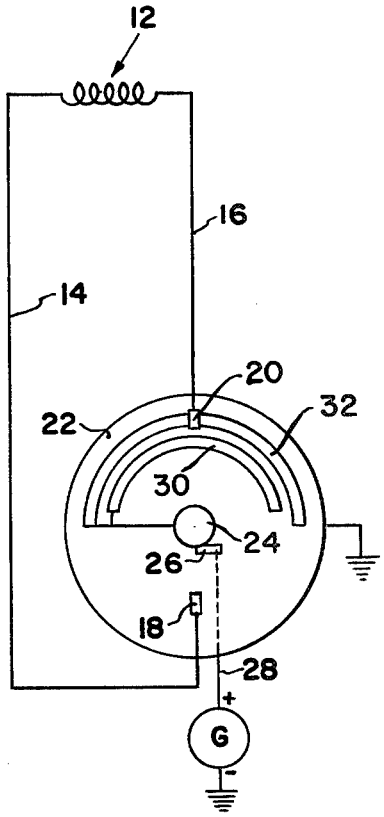
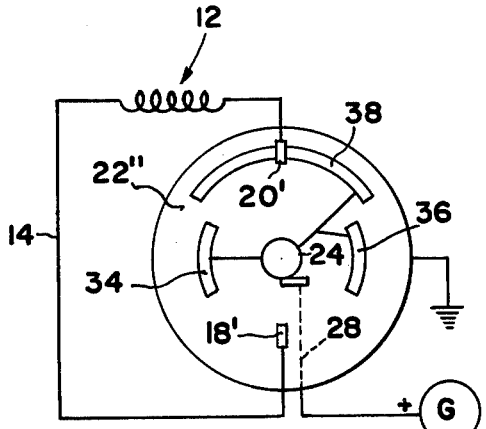
FIG.3
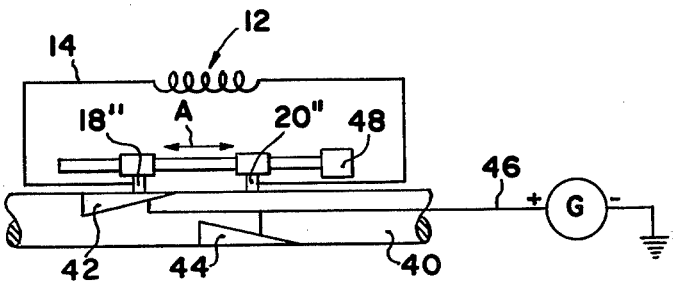
FIG.4

ELECTROMAGNETIC AUGMENTATION OF INTERNAL COMBUSTION ENGINES

BACKGROUND OF THE INVENTION

In a conventional four-stroke internal combustion engine, each piston is driven by the ignition of the fuel charge during only one stroke of its four-stroke cycle. This intermittent application of driving power normally requires the employment of a mechanical flywheel to smooth out the cyclic variation in torque applied to the main drive shaft. The present invention is specifically designed to minimize the torque variation referred to by generating a piston driving force which can be applied to the pistons during any or all of the various strokes of its operating cycle. Although the invention described primarily in connection with its employment in an internal combustion engine operating on a four-stroke cycle, it will be readily apparent that a principle described is equally applicable to engines operating on a two-stroke cycle or to rotary piston engines.

SUMMARY OF THE INVENTION

In accordance with the present invention, a permanent magnet is embedded in or otherwise fixedly mounted upon a paramagnetic piston of an internal combustion engine with the axis of magnetic polarity of the magnet aligned with the direction of movement of the piston. An electromagnetic coil is mounted in a paramagnetic engine block at a location such that the magnetic field generated by the passage of current through the coil will react with the field of the permanent magnet to apply a magnetic attraction or repulsion force to the permanenent magnet. Current is cyclically supplied to the electromagnet coil by a cyclic switching arrangement driven by the engine so that current flow to the coil from a DC source is intermittently interrupted or reversed in synchronism with the piston movement.

A small gain in efficiency, particularly with four-stroke engines, can be achieved by shortening the duration or entirely eliminating the electromagnetic pulse on the power stroke, and it may also be desirable to vary the duration of the electromagnetic pulse in accordance with the load and r.p.m. of the engine.

Other objects and features of the invention will become apparent by reference to the following specification and to the drawings.

IN THE DRAWINGS

FIG. 1 is a schematic diagram showing the application of the invention to a reciprocatory piston engine;

FIG. 2 is a schematic diagram of one form of switching arrangement employed with a reciprocatory engine;

FIG. 3 is a schematic diagram of an alternative form of switching arrangement; and FIG. 4 is a schematic diagram of still another form of switching arrangement.

Referring first to FIG. 1, the invention is shown applied to a reciprocatory piston internal combustion engine with conventional portions of the engine schematically illustrated. The conventional portions of the engine shown include a paramagnetic engine block B within which a paramagnetic piston P is mounted for reciprocation and connected by its connecting rod CR to the crankshaft CS. A fuel-air charge is cyclically supplied through a conventional valve-controlled fuel supply line F for ignition in the conventional manner by the spark plug S, while the operating chamber is exhausted through a conventional exhaust port EX. Although only a single piston and cylinder has been illustrated in FIG. 1, it is believed apparent that identical arrangements would be provided on all cylinders of multi-cylinder engines.

In accordance with the present invention, a permanent magnet 10, preferably of the Alnico series, is embedded in the head of piston P with one pole, for example the North pole, of the magnet at the top surface of the piston so that the axis of magnetic polarity is coincident with the direction of travel of the piston within engine block B. An electromagnetic coil 12 is fixedly mounted in the engine block, preferably in surrounding relationship to the spark plug S, with the coil axis coincident with the axis of magnetic polarity of permanent magnet 10. The external leads 14 and 16 of coil 12, in an exemplary form of switching arrangement, are connected respectively to brushes 18 and 20 engaged with a rotary switch member 22 which is driven in rotation by crankshaft CS so that, in this particular example, the rotary disc 22 rotates at the same speed as crankshaft CS.

Referring to FIG. 2, the rotating disc 22 may take the form of an electrically conductive disc which is permanently electrically grounded. A conductive ring 24, electrically insulated from disc 22, is contacted by a brush 26 which is electrically connected as by a conductive lead 28 to the high side of an engine-driven DC generator G whose opposite side is grounded. Internal electrical connections, electrically insulated from disc 22 electrically connect ring 24 to two semicircular contact strips 30 and 32 mounted on the face of disc 22 and electrically insulated from the disc. Contact strips 30 and 32 are contacted respectively by brushes 18 and 20.

In the exemplary form of switching shown in FIG. 2, each of contact strips 30 and 32 extend around approximately 180° of arc with strip 30 lying at a smaller radial distance from the disc axis than the strip 32. With this arrangement, upon rotation of the discs, each of brushes 18 and 20 will be in electric contact with their respective contact strips 30 and 32 during 180° of rotation of disc 22 and will be in direct contact with the disc face, and hence electrical ground, during the remaining 180° of rotation of disc 22. Thus, upon rotation of disc 22, current flows in one direction through coil 12 for the first 180° of rotation of the disc, and flows in a reverse direction through the coil during the remaining 180° of rotation of the disc. This reversal of current flow through coil 12 is employed to cause the coil to generate a magnetic field reacting with the field of permanent magnet 10 to repel magnet 10 and piston P during the downstroke of piston P, with the reversal of direction of flow of current through coil 12 shifting the electromagnetic field to a polarity attracting piston 10 during the upward stroke of the piston P.

Because a primary purpose of the present invention is to reduce the range of torque variation applied by the piston to the crankshaft in its power stroke as compared to the remaining portions of its operating cycle, it frequently is neither necessary nor desirable to apply an electromagnetic pulse to the piston during its power stroke. In FIG. 3, an exemplary switching arrangement for performing this function in a four-stroke cycle is schematically shown.

The FIG. 3 arrangement includes an engine-driven disc 22′ of construction similar to that of disc 22 but in which the disc 22′ is driven at one-half the rotative speed of the crankshaft so that a single revolution of the disc 22′ corresponds to a single four-stroke cycle of the piston. Arcuate contact strips 34 and 36 are mounted on the face of disc 22′—these two strips 34 and 36 corresponding in function to the strips 30 and 32 of the FIG. 2 embodiment—but being spaced 90° from each other because two upstrokes of the piston will occur during one revolution of the disc 22′.

A third arcuate contact strip 38 is mounted on the face of disc 22′. A generator connection similar to that shown in FIG. 2 is provided to the strips 34, 36 and 38 and a similar brush arrangement 18′, 20′ is provided as indicated and electrically connected to an electromagnetic coil 12′ corresponding to the coil 12 of FIG. 1.

The electrical connections are so arranged that during one-quarter revolution of disc 22′, the piston will be making a downstroke. Assuming this downstroke is the intake stroke of the four-stroke cycle, during this particular quarter revolution of disc 22′, brush 20′ will be in contact with contact strip 38, while brush 18′ will be in contact with the face of disc 22′ and thus connected to ground. The direction of flow of current through coil 12′ will be such as to exert a repelling force on the permanent magnet 10.

During the next quarter revolution—the compression stroke—brush 20′ will be in contact with the face of the disc and grounded, while brush 18′ will be in contact with one of the conductive strips 34 or 36 so that the direction of flow of current through coil 12′ is reversed and piston 10 is magnetically attracted as it travels in its upward compression stroke.

During the next quarter revolution—the power stroke—both brushes 18′ and 20′ will be connected to ground and no magnetic force will be applied to the piston as it moves downwardly in its power stroke.

During the final quarter revolution, brush 20′ will still be grounded to the face of the disc, while brush 18′ will be passing across the other of contact strips 34, 36 to magnetically attract the upwardly moving piston during the exhaust stroke.

In some applications, it may prove to be desirable to vary the duration of application of the magnetic pulsing so that the pulse is applied only for a selected portion of the piston stroke. Depending upon the particular application, such variation may be desirable in the face of variations of engine speed or engine load. An exemplary form of switching system for varying the pulse duration in this manner is shown in FIG. 4. In FIG. 4, an electrically-grounded shaft 40 is driven at crankshaft speed. A pair of contact plates 42, 44 are mounted at the locations indicated on shaft 40, the plates being electrically insulated from the shaft and electrically connected to the output of an engine-driven generator, as by a conductor arrangement 46 likewise electrically insulated from shaft 40. The conductor plates 42, 44 may, for example, be of elongated triangular shape when developed as a flat surface, or of some other shape such that the circumferential extent of the plate on the surface of shaft 40 varies in some predetermined manner in accordance with its axial location on the shaft. Brushes 18″ and 20″ are respectively located to contact conductor plates 42 and 44 and are electrically connected to the coil 12″ in the same manner as the brushes 18 and 20 of the FIG. 2 embodiment. Brushes 18″ and 20″ of the FIG. 4 embodiment are mechanically coupled to each other and mounted for axial movement relative to the shaft 40 in the direction indicated by the double-ended arrow A of FIG. 4. Thus, brushes 18″ and 20″ may remain in contact for nearly a full 180° of rotation of shaft 40 if the brushes are located near the left-hand ends of contact plates 42 and 44 as viewed in FIG. 4, or the brushes may contact plates 42 and 44 only instantaneously during a revolution of shaft 40 if the brushes are axially located near the right-hand ends of contact plates 42 and 44 as viewed in FIG. 4.

Axial shifting movement of the brushes may be accomplished by an engine speed- or load-responsive servo schematically illustrated at 48 in FIG. 4, such devices being well known in the art. Where an engine load-responsive servo 48 is desired, any of several well known engine vacuum-responsive devices may by employed. Engine speed response may be provided, for example, by a flyball type governor or other suitable speed-responsive actuator.

It should be pointed out that because the electromagnetic force exerted by the coil 12 is derived from a generator driven by the engine iself, the power added to the engine by the electromagnetic attraction and repulsion must inherently be less than the power withdrawn from the engine to operate the DC generator which supplies the electric current to operate the electromagnet. Because this system cannot have a 100% efficiency, an overall power loss necessarily takes place. However, the system functions, considering an individual piston, to spread out the power generated by the ignition of a fuel charge over the entire cycle of piston movement so that torque variation throughout the cycle is reduced. This results in a substantially smoother operation of the engine which can, for example, enable a substantial reduction in flywheel weight or improve the smoothness of operation of multi-cylinder engines substantially. Reduction of the range of torque variation within the cycle will increase the engine's operational flexibility which, in turn, creates a potential for significant alteration of valving, porting, timing, fuel ratio, etc., leading to an overall increase in engine efficiency.

While the invention has been explained in terms of simplified schematically-illustrated mechanical switching arrangements, it is believed apparent that the present state of development in the electronic art is such that switching arrangements of much greater flexibility and efficiency of operation for the purposes described are available. It is believed apparent to those skilled in the art that the practice of the present invention requires an engine in which the engine block, pistons, and head are of non-magnetic materials, such as aluminum.

While various embodiments of the invention have been described, it is believed apparent to those skilled in the art that the embodiments described may be modified. Therefore, the foregoing description is to be considered exemplary rather than limiting, and the true scope of the invention is that defined in the following claims.

I claim:

1. In an internal combustion engine having a paramagnetic engine block, including a paramagnetic engine head, and a paramagnetic piston slidably mounted within a cylinder of said paramagnetic engine block for movement within said cylinder in response to cyclic combustion of fuel within said engine;

said engine being operably connected to a generating system;

said generating system comprising generating means operably connected to said engine and to battery storage means;

wherein the improvement comprises:

a permanent magnet fixedly mounted within said paramagnetic piston, with the axis of magnetic polarity of said permanent magnet being disposed parallel to the direction of movement of said paramagnetic piston;

electromagnetic coil means fixedly mounted in said paramagnetic engine head for selectively generating a magnetic field for interacting with the magnetic field of said permanent magnet;

first means connecting said electromagnetic coil means to said generating system, said first means being synchronized with the movement of said paramagnetic piston, so that said electromagnetic coil means exerts an attracting force, at least intermittently, upon said permanent magnet when said permanent magnet is approaching said electromagnetic coil means, and said electromagnetic coil means exerts a repelling force, at least intermittently, upon said permanent magnet when said permanent magnet is moving away from said electromagnetic coil means;

said paramagnetic piston has a plural stroke cycle, wherein at least a portion of a first stroke is a compression stroke, and at least a portion of a second stroke is a power stroke; and said first means connects said electromagnetic coil means to said generating system so that said electromagnetic coil means exerts an attracting force upon said permanent magnet only during a predetermined portion of said compression stroke, and exerts a repelling force upon said permanent magnet only during a predetermined portion of said power stroke.

2. The improvement of claim 1, wherein:

said first means further comprises means for connecting said electromagnetic coil means to said generating system during only a portion of a predetermined stroke of said paramagnetic piston.

3. The improvement of claim 1, wherein:

said first means further comprises second means for selectively varying the ratio between the time during which said electromagnetic coil means is connected to said generating system and the time duration of a predetermined stroke of said paramagnetic piston.

4. The improvement of claim 3, wherein:

said second means further comprises third means responsive to an operating condition of said engine for varying said ratio in response to change in said operating condition.

5. The improvement of claim 4, wherein:

said third means varies said ratio to zero as rotational speed of said engine increases beyond a predetermined limit.

* * * * *